US006966790B2

(12) United States Patent
Roese

(10) Patent No.: US 6,966,790 B2
(45) Date of Patent: Nov. 22, 2005

(54) LOCKABLE ELECTRICAL PLUG AND SOCKET CONNECTION

(75) Inventor: Frank Roese, Hamburg (DE)

(73) Assignee: Airbus Deutschland GmbH, Hamburg (DE)

( * ) Notice: Subject to any disclaimer, the term of this patent is extended or adjusted under 35 U.S.C. 154(b) by 0 days.

(21) Appl. No.: 10/952,070

(22) Filed: Sep. 27, 2004

(65) Prior Publication Data

US 2005/0106924 A1 May 19, 2005

(30) Foreign Application Priority Data

Sep. 27, 2003 (DE) ..... 103 44 955

(51) Int. Cl.[7] ..... H01R 13/627

(52) U.S. Cl. ..... 439/353; 439/352; 439/372; 439/489

(58) Field of Search ..... 439/352, 353, 439/357, 358, 489, 157, 160, 372, 923

(56) References Cited

U.S. PATENT DOCUMENTS

| | | | | |
|---|---|---|---|---|
| 4,556,270 A | | 12/1985 | Schuetzle et al. | |
| 5,575,678 A | * | 11/1996 | Okumura et al. | 439/372 |
| 5,713,752 A | | 2/1998 | Leong et al. | |
| 5,788,527 A | | 8/1998 | Sanders et al. | |
| 5,873,737 A | * | 2/1999 | Hashizawa et al. | 439/39 |
| 5,997,333 A | | 12/1999 | Konda et al. | |
| 6,059,598 A | | 5/2000 | Yamashita et al. | |
| 6,065,991 A | | 5/2000 | Fukuda | |
| 6,146,182 A | | 11/2000 | Wang et al. | |
| 6,276,841 B1 | | 8/2001 | Demangone | |
| 6,361,334 B1 | * | 3/2002 | Konoya et al. | 439/144 |
| 6,364,685 B1 | | 4/2002 | Manning | |
| 6,383,009 B2 | * | 5/2002 | Kawase et al. | 439/352 |
| 6,383,032 B1 | | 5/2002 | Gerberding | |
| 6,517,372 B1 | | 2/2003 | Jones | |
| 6,582,256 B2 | | 6/2003 | Sakurai et al. | |
| 6,638,108 B2 | | 10/2003 | Tachi | |
| 6,666,728 B2 | | 12/2003 | Tachi et al. | |
| 6,682,359 B1 | * | 1/2004 | Hitchcock et al. | 439/157 |
| 6,688,907 B2 | * | 2/2004 | Yamaoka et al. | 439/489 |
| 6,786,754 B2 | * | 9/2004 | Yamaoka et al. | 439/352 |

FOREIGN PATENT DOCUMENTS

DE 3041938 6/1982

OTHER PUBLICATIONS

Frank Roese, U.S. Appl. No. 11/003,954, filed on Dec. 3, 2004.

* cited by examiner

*Primary Examiner*—P. Austin Bradley
*Assistant Examiner*—X. Chung-Trans
(74) *Attorney, Agent, or Firm*—W. F. Fasse; W. G. Fasse

(57) ABSTRACT

An electrical plug has locking hooks on the ends of flexible arms extending from its housing. An electrical socket has locking receivers on its housing. When the plug is connected with the socket, the locking hooks engage the locking receivers to form a locked connection. A spring-loaded unlocking bail is pivotally arranged on the housing of the socket. Finger pressure applied to the bail against the spring bias pivots the bail so that its bail legs pivot over and press against protrusions of the flexible arms, to inwardly deflect the arms and disengage the locking hooks from the locking receivers, thereby unlocking the arrangement so that the plug can be separated from the socket.

15 Claims, 2 Drawing Sheets

LOCKABLE ELECTRICAL PLUG AND SOCKET CONNECTION

PRIORITY CLAIM

This application is based on and claims the priority under 35 U.S.C. §119 of German Patent Application 103 44 955.8, filed on Sep. 27, 2003, the entire disclosure of which is incorporated herein by reference.

FIELD OF THE INVENTION

The invention relates to a lockable electrical connection established by an electrical plug and an electrical counter-plug or socket that can be selectively plugged together and locked.

BACKGROUND INFORMATION

It is generally known to provide an electrical connector plug and socket combination that can be plugged together and then mechanically locked to prevent an inadvertent disconnection or loosening thereof. For example, it is known to provide flexible arms having locking hooks or "snap hooks" on the ends thereof, on a housing of the connector plug, and to provide locking receivers or counter-recesses on the housing of the counter-plug or socket. When the plug and socket are plugged together, the locking hooks snap and engage into the locking receivers or counter-recesses. Thereby, the plug and socket are mechanically locked or securely held together.

Electrical plug and socket connections of the above mentioned type are generally known, in principle, from the German Patent Publication DE 30 41 938 C2. Among other applications, such plug and socket connections are widely used in aircraft manufacturing technology.

In a modern conventional design of such an electrical plug and socket connection, the locking mechanism includes two locking snap hooks provided on opposite sides of the housing of the connector plug. Particularly, the locking snap hooks are provided on flexible arms formed on the sides of the housing of the connector plug. These locking snap hooks are selectively unlockable or disengageable from the locking receivers of the socket by applying lateral finger pressure to the flexible arms, so as to inwardly deflect the flexible arms and thereby release the locking snap hooks from the locking receivers. Then, the plug and socket connection can be separated by pulling apart the plug and socket.

While the conventional construction of such a locking mechanism using locking snap hooks on flexible arms is relatively simple and economical in its construction and in its utilization, it unfortunately requires a certain free access space on both sides of the locking snap hooks to make it possible to apply the required finger pressure to the flexible arms or snap hooks for unlocking the same. For example, in a typical conventional case, a lateral unobstructed space of about 80 mm is necessary in the plane of the opening of the connection arrangement to allow the necessary finger access to the locking snap hooks. In many installations, it is not possible to provide such a clear lateral access space at the sides of the connection arrangement, and in any event, this limits the ability to cluster several plug and socket connections or other elements next to one another.

SUMMARY OF THE INVENTION

In view of the above, it is an object of the invention to provide an electrical plug and socket connection arrangement that can be selectively connected, locked, unlocked, and disconnected through simple manual operations in the tightest or smallest space possible, and especially without requiring a clear access space at the sides of the connection arrangement. The invention further aims to avoid or overcome the disadvantages of the prior art, and to achieve additional advantages, as apparent from the present specification. The attainment of these objects is, however, not a required limitation of the claimed invention.

The above objects have been achieved according to the invention in a lockable electrical connection arrangement including a connector plug and a connector socket that can be selectively plugged together or separated, i.e. connected or disconnected. The plug and the socket can be generically regarded as a first connector and a second connector, or vice versa. Also, the terms plug and socket simply imply that the two connectors can be mated or plugged together, and do not necessarily require a particular male or female configuration of either one of these connectors. The plug includes a first electrical contact in a housing having locking members extending therefrom. The locking members preferably comprise flexible arms with locking hooks provided on free ends thereof. The socket includes a second electrical contact in a second housing having locking receivers, e.g receiving recesses that are positioned and adapted to receive and engage with the locking hooks of the plug when the plug and socket are connected to each other so as to form an electrical connection between the first and second contacts. The locking hooks may thus be called "snap hooks" if they snap into engagement with the locking receivers under the elastic restoring force of the flexible arms. The housings, the flexible arms, and the locking hooks can be made of any suitable plastic, for example.

Further according to the invention, the socket or second connector further includes an unlocking lever preferably embodied as an unlocking bail pivotally supported by or connected to the housing of the socket. This unlocking bail is spring-loaded to be pivotally biased toward a retracted or inactive position of its pivot range. Away from the retracted or inactive position, the pivot range of the unlocking bail extends over the flexible arms of the plug or first connector. When the unlocking bail is pivoted over the flexible arms, it depresses the arms so as to disengage the locking snap hooks from the locking receivers. In this regard, the plug or first connector preferably further includes respective protrusions that protrude from the flexible arms into the pivot path of the unlocking bail, so that the unlocking bail contacts and presses against these protrusions when the bail is pivoted into an active unlocking position. Thereby the arms are deflected and the locking snap hooks are released from the locking receivers.

Preferably, the locking hooks and the protrusions protrude laterally outwardly from the flexible arms, the locking receiver is oriented laterally inwardly, and the unlocking bail is effective to depress the flexible arms laterally inwardly. However, that arrangement may be reversed, with the locking hooks and protrusions protruding laterally inwardly, the locking receiver oriented laterally outwardly, and the unlocking bail being effective to spread the flexible arms laterally outwardly. Also, instead of the hooks being at the ends and the protrusions being at the middle portions of the flexible arms, that arrangement could also be reversed, with the hooks at the middle portions and the protrusions at the ends of the flexible arms.

With the above described arrangement including the unlocking bail, the invention achieves a substantial advantage of avoiding the need of a lateral clear space to allow finger access to the flexible arms for unlocking the locking snap hooks. Instead, the unlocking bail simply needs to be pivoted with one finger, e.g. from the front face of the socket or second connector, and the bail in turn applies the necessary lateral pressure onto the flexible arms so as to deflect the arms and thereby unlock or release the locking snap hooks from the locking receivers. Thus, the invention achieves a significant reduction of the required installation space of the electrical connection arrangement, while still making it possible to unlock and disconnect the connection arrangement by hand in a simple manner.

BRIEF DESCRIPTION OF THE DRAWINGS

In order that the invention may be clearly understood, it will now be described in connection with example embodiments thereof, with reference to the accompanying drawings, wherein.

DETAILED DESCRIPTION OF PREFERRED EXAMPLE EMBODIMENTS AND OF THE BEST MODE OF THE INVENTION

The inventive electrical connection arrangement includes a first connector and a second connector that can be selectively connected and locked as well as unlocked and disconnected from each other. In the present example embodiment, the first connector is represented by a connector plug 1 while the second connector is represented by a counter-plug or connector socket 11, whereby the plug 1 and socket 11 are configured to be selectively plugged together while establishing an electrical and mechanical connection therebetween.

Figure 1:
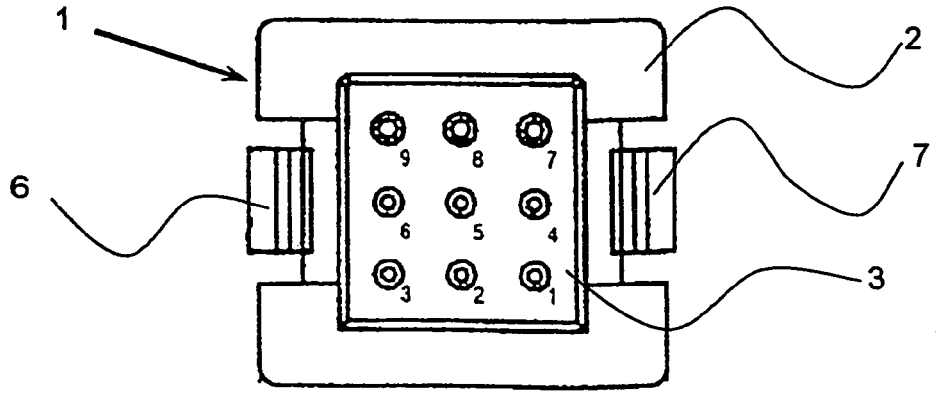
FIG. 1 is a front view of a connector plug or first connector with a pin contact arrangement, of the inventive electrical connection arrangement.
Figure 2:
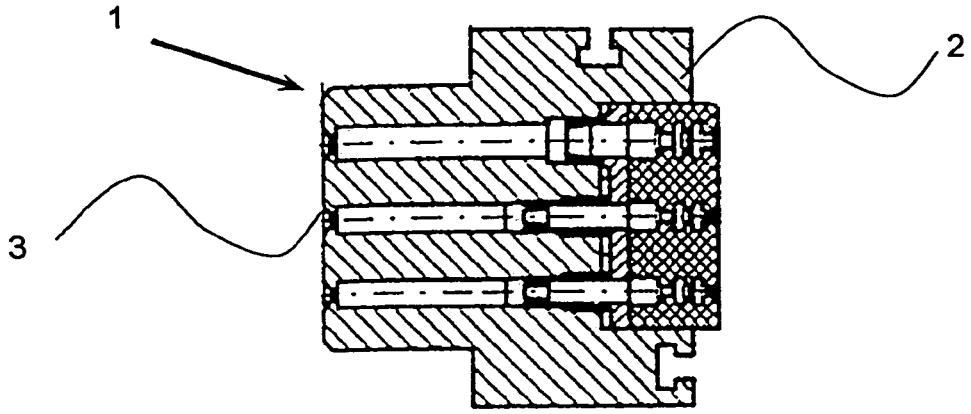
FIG. 2 is a vertical section through the connector plug according to FIG. 1.
Figure 3:
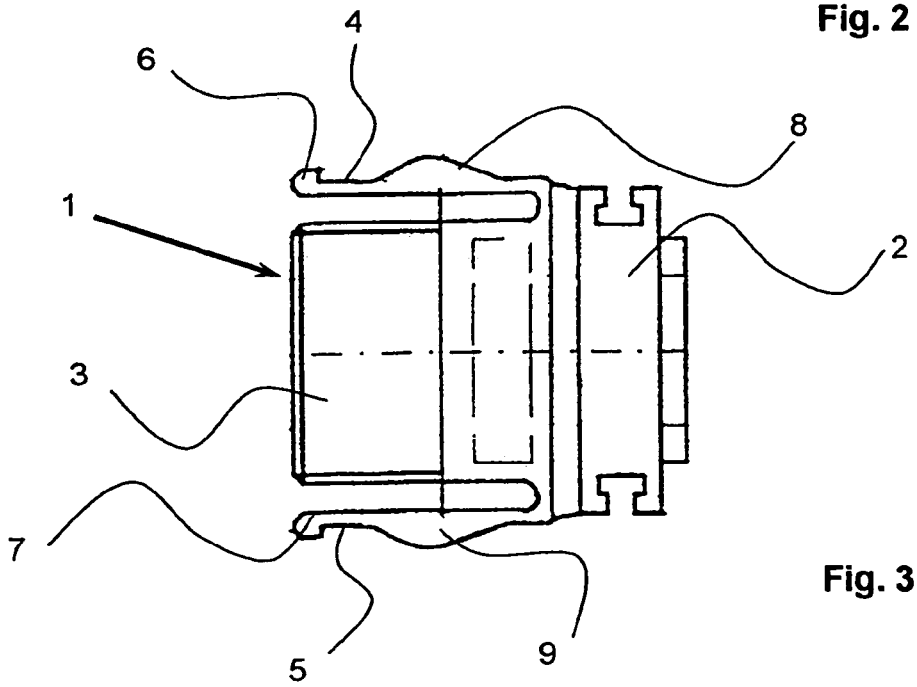
FIG. 3 is a top view of the connector plug according to FIG. 1.
Figure 4:
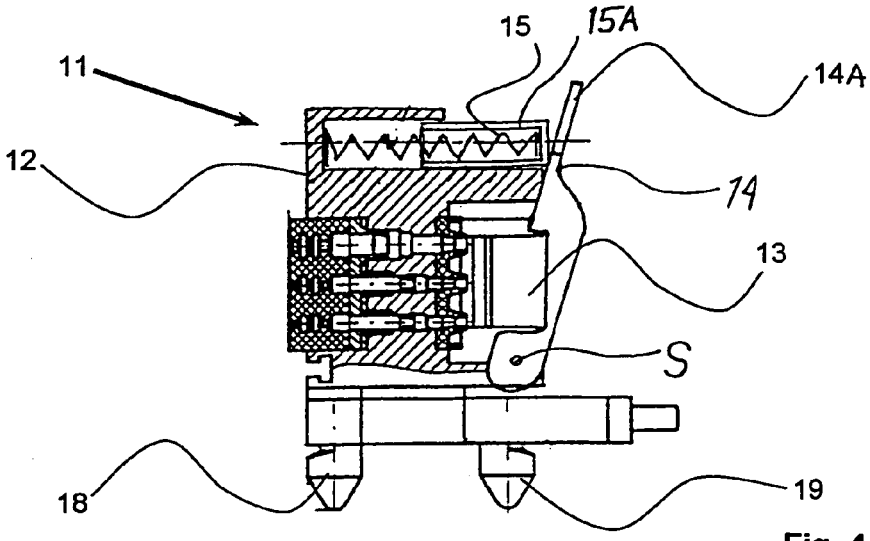
FIG. 4 is a vertical sectional view through a first embodiment of a connector socket or counter-plug or second connector of the inventive electrical connection arrangement.
Figure 5:
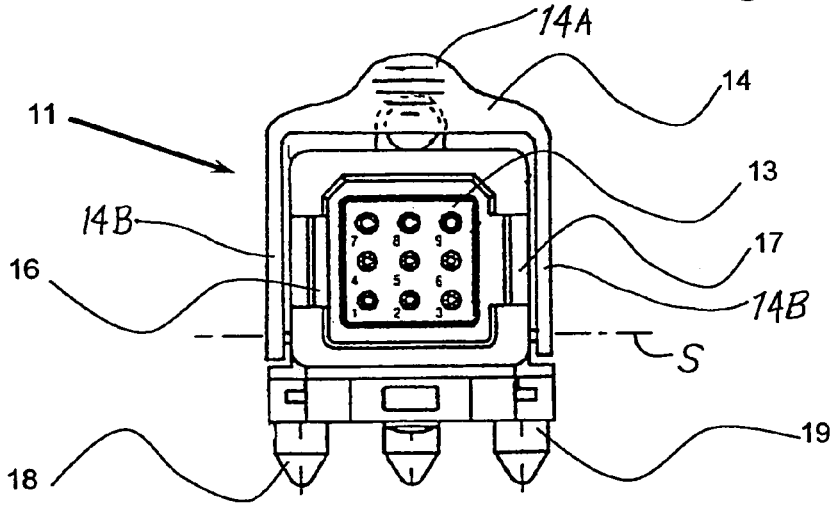
FIG. 5 is a front view (from the right of FIG. 4) of the connector socket according to FIG. 4.

The connector plug 1 is shown in a front view, a vertical sectional view, and a top view, respectively in FIGS. 1, 2 and 3. The connector plug 1 includes an electrical contact arrangement 3 having a total of nine electrical contact pins received in an insulating housing 2. Particularly, the contact pins of the electrical contact arrangement 3 extend from front to back through the housing 2, as can be seen in the sectional view of FIG. 2. As can be seen especially in FIGS. 1 and 3, the connector plug 1 further includes two flexible arms 4 and 5 that are preferably integrally formed (e.g. integrally molded) with and protrude from the housing 2. Laterally outwardly projecting locking snap hooks 6 and 7 are respectively provided on the distal free ends of the two flexible arms 4 and 5. Moreover, respective ramp-shaped or bulge-shaped protrusions 8 and 9 are formed on and protrude laterally outwardly from the lateral outer side of the middle portion of the arms 4 and 5 respectively. As can be seen in FIGS. 4 and 5, a first embodiment of the second connector or socket 11 comprises an electrical socket arrangement 13 that is received in an insulating housing 12 and adapted to receive and electrically contact the contact pins of the contact arrangement 3 of the connector plug 1. Namely, this socket arrangement 13 includes nine individual electrical sockets adapted to receive the nine electrical contact pins of the contact arrangement 3 of the plug 1. The connector socket 11 further includes locking receivers (e.g. including receiver recesses) 16 and 17 that are arranged inwardly-facing respectively at the two sides of the housing 12, with respective spaces between the locking receivers and the sides of the housing 12, adapted to receive and engage with the locking snap hooks 6 and 7 of the connector plug 1.

When the plug 1 and socket 11 are plugged together, the locking snap hooks 6 and 7 of the plug 1 will be received respectively between the locking receivers 16, 17 and the side of the housing 12 of the socket 11, so that the locking snap hooks 6 and 7 will snap and engage behind the locking receivers 16 and 17 when the plug 1 and socket 11 are pushed together into a completely engaged and locked position. In that position, the contact pin arrangement 3 of the plug 1 will be engaged with and electrically contacting the socket arrangement 13 of the connector socket 11.

The connector socket 11 further includes an unlocking bail 14 extending in an inverted U-shape along the two sides and over the top of the housing 12 of the connector socket 11. The unlocking bail 14 is pivotally mounted or connected to the housing 12 about a pivot axis S. A spiral compression spring 15 supported in the housing 12 bears against a biasing stud 15A, which in turn bears against and biases the unlocking bail 14 in a pivoting direction about the pivot axis S toward a retracted or inactive position as shown in FIG. 4 (see also FIG. 6). By applying finger pressure onto the bail 14, e.g. onto a finger tab 14A provided for this purpose, in a direction contrary to the biasing direction of the biasing spring 15, the unlocking bail 14 can be pivoted about the pivot axis S toward the electrical socket arrangement 13 (i.e. toward the left in FIG. 4).

When the connector plug 1 and the connector socket 11 are plugged together, i.e. in the connected, engaged and locked condition with the locking snap hooks 6 and 7 engaged with the locking receivers 16 and 17, the above mentioned manual pivoting of the unlocking bail 14 (toward the left in FIG. 4) will be effective to disengage the locking snap hooks 6 and 7 from the locking receivers 16 and 17, and thereby unlock the arrangement. Namely, as the unlocking bail 14 is pivoted from the retracted or inactive position toward the left, the side legs 14B of the bail 14 pivot over and thus contact the ramp-shaped protrusions 8 and 9 protruding outwardly from the flexible arms 4 and 5. Thereby, the bail legs 14B of the unlocking bail 14 apply a laterally inwardly directed force or pressure onto the ramp-shaped protrusions 8 and 9, which serves to laterally inwardly deflect the arms 4 and 5. Namely, the ramp effect of the ramp-shaped protrusions 8 and 9 causes the flexible arms 4 and 5 to deflect inwardly as the unlocking bail 14 is pivoted progressively toward the left in FIG. 4, i.e. with the bail legs 14B sliding and ramping progressively over the protrusions 8 and 9. As the flexible arms 4 and 5 are deflected inwardly (i.e. toward the contact pin arrangement 3 or a centerline of the plug 1), the locking snap hooks 6 and 7 become disengaged from the locking receivers 16 and 17. Then, the connector plug 1 may be easily manually unplugged, i.e. pulled away from, the connector socket 11.

The connector socket 11 may further include mounting elements such as catch elements 18 and 19 formed on and protruding from the housing 12, whereby the socket 11 may be fixed or securely mounted on a mounting frame or the like (not shown).

When plugging together the connector plug 1 and the connector socket 11, the ramp-shaped protrusions 8 and 9 of the flexible arms 4 and 5 will contact and thus press against the bail legs 14B of the unlocking bail 14. Thereby, during the plug-coupling procedure, the protrusions 8 and 9 will tend to pivot the unlocking bail 14 out of its inactive or retracted position toward the left in FIG. 4. For this reason, in the present example embodiment, the spring force of the spiral biasing spring 15 is selected to be greater than the sum of the forces applied by the two opposite locking snap hooks 6 and 7, i.e. the forces exerted by the flexible arms 4 and 5 due to their elastic nature. In this manner it is ensured that the biasing spring 15 will be effective to push and return the unlocking bail 14 to its initial retracted position as shown in FIG. 4, so that the bail 14 allows the hooks 6 and 7 to engage with the locking receivers 16 and 17. This also ensures that the bail 14 will be ready and available in its proper initial position, to be manually depressed or pushed against the spring bias to carry out the unlocking process at a later time when the connection arrangement is again to be unlocked and disconnected.

A second example embodiment of the inventive connection arrangement corresponds to the above described embodiment, except for additional features that avoid the above mentioned interaction of the protrusions 8 and 9 with the unlocking bail 14 during the plug-coupling procedure. This second example embodiment is shown in FIGS. 6 and 7, whereby FIG. 6 shows the locking portion of this connection arrangement in the locked condition and FIG. 7 shows this portion during the unlocking and disconnecting process.

In this second embodiment, the spring force of the biasing spring 15 does not need to be greater than, and is selected to be less than, the sum of the forces exerted by the opposite locking snap hooks 6 and 7, i.e. the forces exerted by the elastic flexible arms 6 and 7, which are identical to the first embodiment described above in connection with FIGS. 1 and 3. The reason that the spring force of the spring 15 may be less in this embodiment is that the protrusions 8 and 9 of the arms 4 and 5 do not push against the unlocking bail 24 during the plug-coupling procedure in this embodiment. In this regard, the locking receivers 26 of the connector socket 21 do not simply entail a catch recess or the like (as may be the case in the first embodiment), but instead further include a counter-protrusion 27 that may be formed by an undercut in the housing 22. This counter-protrusion 27 has an excessive or increased height protruding inwardly relative to the insertion path or opening provided for receiving the locking snap hook 6 (and 7) on the arm 4 (and 5) during the insertion thereof.

Thus, during the plug-coupling process, as the locking snap hooks 6 and 7 are inserted, as soon as the locking snap hooks 6 reach the respective counter-protrusions 27 of the locking receiver 26, the flexible arms 4 and 5 will be deflected laterally inwardly, sufficiently so that the protrusions 8 and 9 are laterally clear of, and do not push against, the unlocking bail 24. Thus, the bias spring 15 can maintain or return the unlocking bail 24 automatically to the initial retracted position thereof, even though the spring 15 has a spring force less than the forces exerted by the snap hooks 6 and 7, i.e. the flexible arms 4 and 5.

Figure 6:
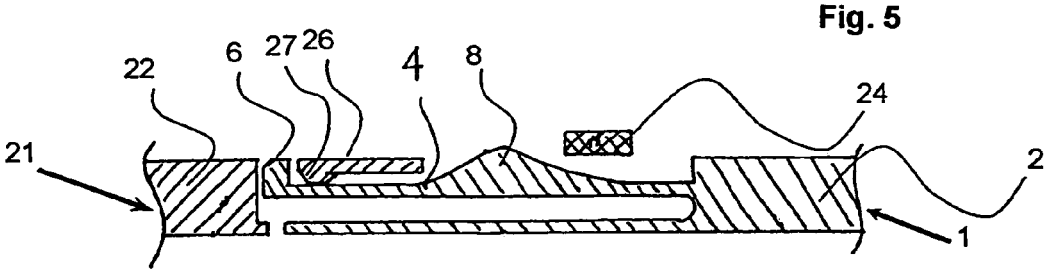
FIG. 6 is a detailed sectional view along a horizontal section plane through the interconnection area of a connector plug and connector socket according to a second embodiment of the invention, in a locked condition.
Figure 7:
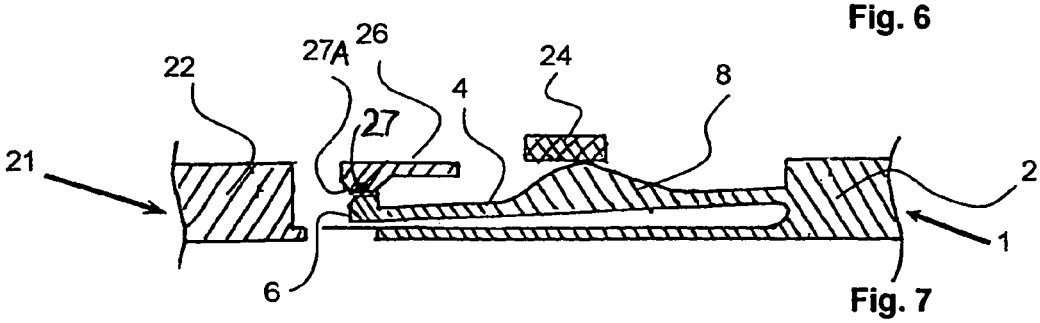
FIG. 7 is a view similar to that of FIG. 6, but showing the arrangement in an unlocked condition with the plug beginning to be separated from the socket.

In order to unlock and unplug the arrangement according to the second embodiment, the unlocking bail 24 is pushed by finger pressure toward the locking snap hooks 6 and 7, i.e. toward the left in FIGS. 6 and 7, so that the bail 24 contacts and exerts a laterally inward force on the ramp-shaped protrusions 8 and 9, in the same manner as described above for the first embodiment. Thereby, the arms 4 and 5 are deflected so that the locking snap hooks 6 and 7 are disengaged from behind the respective locking receiver 26, and then the locking snap hooks 6 can be pulled out past the respective counter-protrusions 27. This process can be facilitated by providing a bevel 27A on the back edge of the counter-protrusion 27. Similarly, the opposite insertion process can be facilitated by providing similar bevels on the front edge of the counter-protrusion 27 and on the front edge of the locking snap hook 6.

In both above described embodiments, the unlocking of the arrangement is simple to carry out using only one hand, and then the plug connection can be disconnected also using one hand, in a single continuous procedure. For example, a person wishing to disconnect the electrical connection arrangement grips and holds the connector plug 1 between the thumb and middle finger, and then presses the unlocking bail 14 or 24 with the index finger so as to unlock the arrangement as described above. Then the connector plug 1 can be pulled out of the connector socket 11 or 21 by continuing to hold, and pulling, the plug 1 between the thumb and middle finger.

Although the invention has been described with reference to specific example embodiments, it will be appreciated that it is intended to cover all modifications and equivalents within the scope of the appended claims. It should also be understood that the present disclosure includes all possible combinations of any individual features recited in any of the appended claims.

What is claimed is:

1. A lockable electrical connection comprising first and second connectors that can be selectively connected and disconnected with respect to one another, wherein:

said first connector includes a first housing, a first electrical contact in said first housing, and a deflectable locking member extending from said first housing; and said second connector includes a second housing, a second electrical contact in said second housing, a locking receiver provided on said second housing, an unlocking lever pivotally connected to said second housing to be pivotal between an inactive position and an active position, and a biasing spring arranged between said second housing and said unlocking lever to exert a biasing force on said unlocking lever to bias said unlocking lever toward said inactive position;

wherein:

said locking member and said locking receiver are adapted to engage with one another in a locked condition when said first connector and said second connector are connected together in a connected condition, so as to lock said connected condition;

said first and second electrical contacts are brought into electrical contact with one another when said first and second connectors are connected together into said connected condition; and when said first and second connectors are in said connected condition, said unlocking lever can be pivoted to said active position in which said unlocking lever acts on and deflects said locking member out of engagement with said locking receiver so as to release said locked condition and unlock said connected condition.

2. The lockable electrical connection according to claim 1, wherein said first connector is a connector plug and said second connector is a connector socket.

3. The lockable electrical connection according to claim 1, wherein said biasing spring exerts said biasing force being greater than a total sum of counter-forces exerted on said unlocking lever by one or more of said locking members.

4. The lockable electrical connection according to claim 1, wherein said biasing spring exerts said biasing force being less than a total sum of counter-forces exerted on said unlocking lever by one or more of said locking members, and wherein said locking receiver includes a counter-protrusion with a lateral protrusion height at least as large as, and directed contrary to, a lateral protrusion height of a locking hook of said locking member.

5. The lockable electrical connection according to claim 1, wherein said pivot axis extends parallel to a junction plane defined by respective faces of said first and second connectors facing each other in said connected condition.

6. The lockable electrical connection according to claim 1, wherein said unlocking lever is adapted to be pivoted from said inactive position to said active position by application of manual finger pressure to said unlocking lever against said biasing force.

7. The lockable electrical connection according to claim 1, wherein:

said locking member comprises a flexible arm extending from said first housing, a locking hook disposed at a free end of said flexible arm, and a protrusion protruding laterally from said flexible arm;

said locking hook is adapted to engage with said locking receiver in said locked condition; and said protrusion and said unlocking lever are positioned so that said unlocking lever contacts and presses laterally on said protrusion to deflect said flexible arm and thereby move said locking hook out of engagement with said locking receiver when said unlocking lever is in said active position.

8. The lockable electrical connection according to claim 7, wherein said unlocking lever in said inactive position does not contact said protrusion.

9. The lockable electrical connection according to claim 7, comprising two of said locking members respectively on opposite sides of said first housing.

10. The lockable electrical connection according to claim 9, wherein said unlocking lever comprises an unlocking bail including two bail legs respectively located on opposite sides of said second housing and respectively cooperating with said two locking members.

11. The lockable electrical connection according to claim 7, wherein said locking hook and said protrusion each respectively protrude laterally outwardly from said flexible arm in a direction away from said first housing.

12. The lockable electrical connection according to claim 7, wherein said locking receiver includes a recess that is laterally inwardly open toward said second housing and that is adapted to receive said locking hook engaged therein.

13. The lockable electrical connection according to claim 7, wherein said locking receiver includes a counter-protrusion that protrudes laterally inwardly toward said second housing, and that is adapted to engage with said locking hook reaching behind said counter-protrusion.

14. The lockable electrical connection according to claim 7, wherein said protrusion has a ramp-shape ramping in a lateral direction.

15. A lockable electrical connection arrangement comprising a first connector and a second connector that can be selectively connected and disconnected with respect to one another, wherein:

said first connector comprises a first housing, a first electrical contact in said first housing, two flexible arms extending respectively from opposite sides of said first housing, two locking hooks provided respectively on said two flexible arms, and two protrusions protruding respectively from said two flexible arms;

said second connector comprises a second housing, a second electrical contact in said second housing, two locking receivers provided respectively on opposite sides of said second housing, and an unlocking bail that is pivotally connected and spring-biased relative to said second housing;

wherein:

said first and second connectors are adapted to be selectively connected together in a connected condition in which said first and second electrical contacts are electrically contacted with one another and said hooks are respectively engaged with said locking receivers; and said unlocking bail is pivotable over a pivoting range from an inactive position to an active position in which said unlocking bail contacts said protrusions and thereby deflects said flexible arms and moves said hooks out of engagement with said locking receivers.

* * * * *